United States Patent [19]

Romagnoli

[11] 4,288,224

[45] Sep. 8, 1981

[54] APPARATUS FOR SECURING A SUSPENSION THREAD TO FILTER BAGS FOR INFUSION PRODUCTS

[75] Inventor: Andrea Romagnoli, Bologna, Italy

[73] Assignee: IMA - Industria Macchine Automatiche S.p.A., Ozzano Emilia, Italy

[21] Appl. No.: 51,655

[22] Filed: Jun. 25, 1979

[30] Foreign Application Priority Data

Mar. 6, 1979 [IT] Italy ..... 3341 A/79

[51] Int. Cl.[3] ..... B31B 1/90

[52] U.S. Cl. ..... 493/345; 53/134; 493/357; 493/375; 493/961

[58] Field of Search ..... 93/91, 87, 8 WA, 8 R, 93/1 TS, 35 DS, 35 H; 53/134

[56] References Cited

U.S. PATENT DOCUMENTS

| | | | |
|---|---|---|---|
| 1,752,730 | 4/1930 | Carlson | 93/91 |
| 2,334,256 | 11/1943 | Eaton | 53/134 X |
| 2,360,510 | 10/1944 | Murray | 53/134 X |
| 2,368,429 | 1/1945 | Sidebotham | 53/134 |
| 3,566,573 | 3/1971 | Irmscher | 53/134 X |

FOREIGN PATENT DOCUMENTS

| | | | |
|---|---|---|---|
| 704669 | 3/1965 | Canada | 53/134 |
| 1281927 | 10/1968 | Fed. Rep. of Germany | 53/134 |

*Primary Examiner*—James F. Coan
*Attorney, Agent, or Firm*—Karl F. Ross

[57] ABSTRACT

Apparatus for securing a suspension thread to filter bags made of filter papers intended for infusion products, comprises means for attaching tags at regular intervals to a thread including, an intermittently rotatable member having a plurality of radial arms. Each arm carries means for gripping that thread portion with which a tag happens to be associated. The rotation of the rotatable member causes the thread to be unwound. A thread-cutting and tag-tilting station located downstream of the tag causes the tag to overlap the thread portion located upstream thereof, to form a kind of loop in the thread. Means are further provided for sealing at several points the cut thread portion, and related tag, to a web of filter paper arranged to run over the rotatable member.

5 Claims, 4 Drawing Figures

III
98
97
108
2
100
107
106
65
72
69
74
76
70
78
2a
69a
1
49
47
33
A
54a
54b
59
45
53
51
58
54
52
50
C
60
56
51
53
49
2
4
F
23b
24
1
3
5a
25
12
13
5
8
6
9

101
102
103
104
99
100
48b
48a
105
96
97
47
44
46
36
40
35
34
32
98
33
57
54
54b
55
37
38
62
63
61
64
56
45
59
50
52
42
41
39
43

APPARATUS FOR SECURING A SUSPENSION THREAD TO FILTER BAGS FOR INFUSION PRODUCTS

SPECIFICATION

Field of the Invention

This invention relates to an apparatus for securing a suspension thread to filter bags intended for infusion products.

Background of the Invention

It is known that for preparing infusion beverages, such as tea and the like, widespread use is currently made of prepackaged filter bags containing the required amount of the product and suitable for dipping directly into an appropriate amount of water. The special filtering paper of the bags is in fact capable of allowing diffusion of the substance into the liquid, while retaining the solid residue.

Such filter bags, which are produced in several different configurations, are all provided with a suspension thread, or string, generally carrying at its free end a tag of sorts, which allows the bag to be withdrawn from the beverage upon completion of the infusion process.

Object of the Invention

The present invention has as its object to provide an apparatus which is capable of carrying out automatically the application of a suspension thread to such filter bags without resorting to metal staples and the like fastening means.

Summary of the Invention

The invention provides an apparatus having the cited properties which also affords the possibility of attaching a respective tag to the thread of the filter bag, while being as simple as possible in design, reliable in operation, and suitable for high production rates, thereby rendering its manufacture advantageous from all standpoints.

According to one aspect of the present invention, there is provided an apparatus for securing a suspension thread to filter bags intended for infusion products, said filter bags being made of filter paper, which comprises means for attaching tags at regular intervals to a thread, an intermittently rotatable member having a plurality of radial arms, each one of said radial arms carrying means for gripping that thread portion wherewith a tag happens to be associated, the rotation of said rotatable member causing the thread to be unwound, a thread-cutting and tag-tilting station located downstream of the tag causing the tag to overlap the thread portion located upstream thereof, such as to form a sort of loop in said thread, and means for sealing at several points the cut thread portion, and related tag, to a web of filter paper arranged to run over said rotatable member.

Brief Description of the Drawings

The details of the present invention will be more clearly apparent from a detailed description of a preferred embodiment of the apparatus, illustrated by way of example in the accompanying drawing, in which.

Description of the Preferred Embodiments

Figure 1:
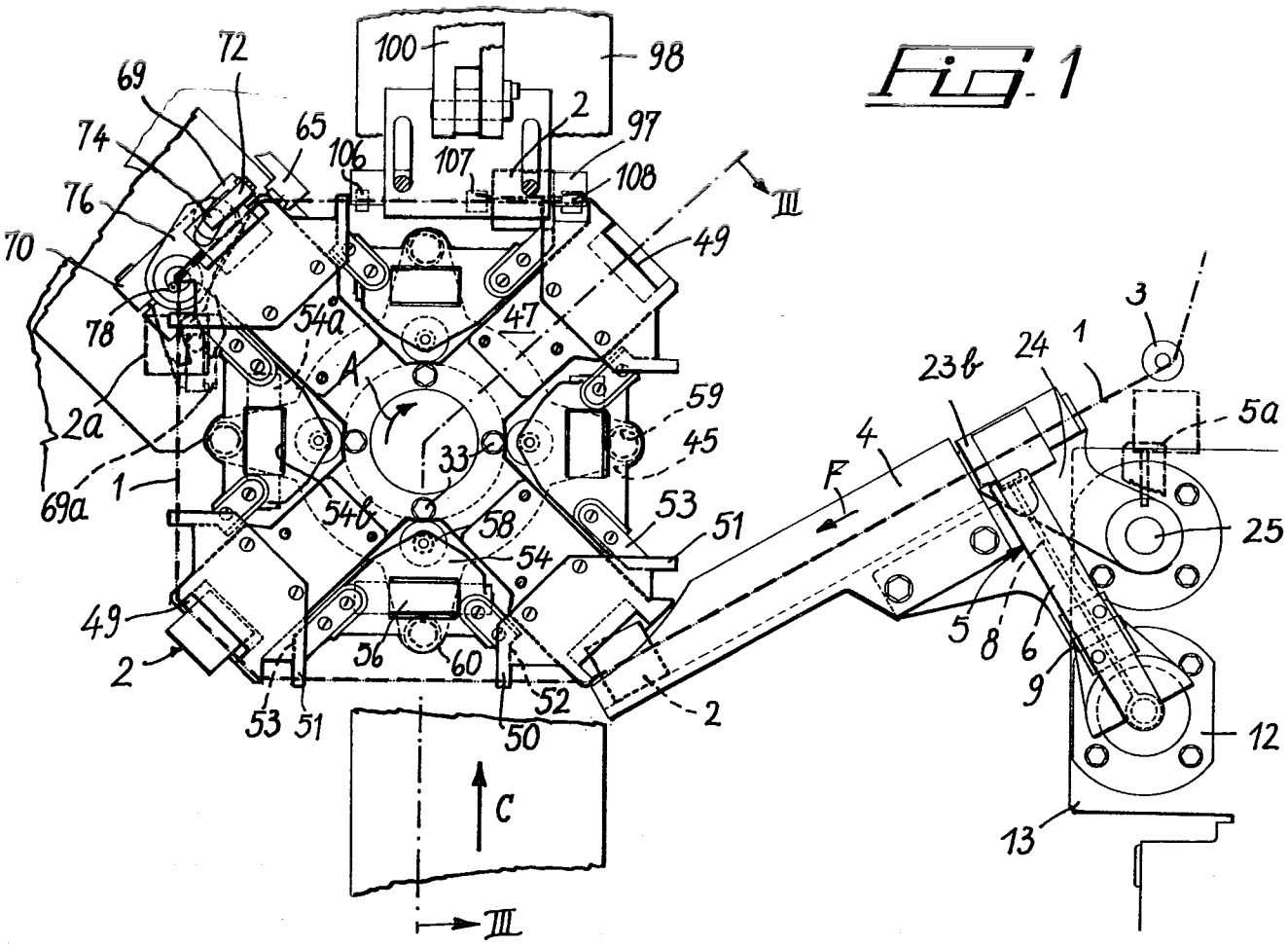
FIG. 1 is a front view of the instant apparatus.

With reference to the drawing figures, there is indicated generally at 1 a thread or string from which segments are cut in succession which, along with respective tags 2, can be secured to conventional filter bags for infusion products. The thread 1, which is unwound from a reel not shown, after passing over a roller 3, comes down along a guide 4 which has an inclination in a vertical plane, from top to bottom, in the direction of advance F of the thread. At the upper end of said guide 4, there takes place the insertion and sealing to the thread 1 of the tags 2, in succession and at regular intervals, which tags are folded over upon themselves to a V-like configuration with open end facing upwards.

Figure 2:
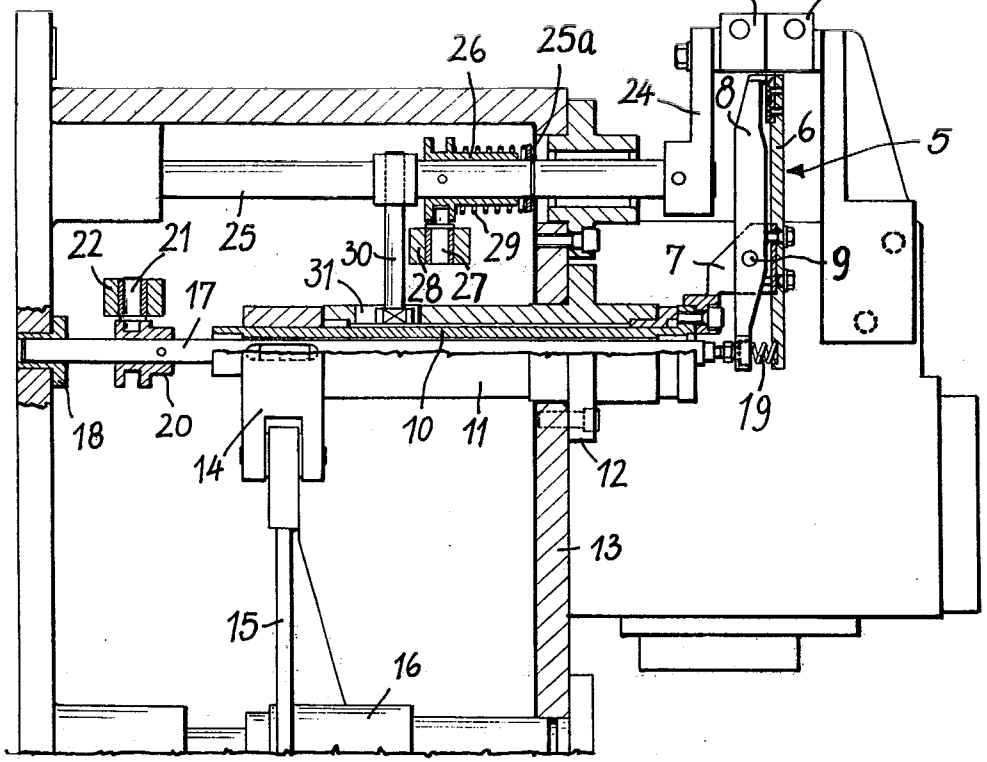
FIG. 2 is a view, in longitudinal section, of the tag-delivering means.

A gripper 5 shown in particular, along with the members intended for actuating it, in FIG. 2 is provided for picking up the tags. The gripper 5 is mounted for a rocking movement in the same vertical plane as the guide 4, beneath the thread 1, between a position, represented by the dotted line 5*a*, where one tag 2 is picked up, and a position where said tag is inserted astride the thread 1. At this second position, there are provided means for sealing the two tag flaps, as will be explained hereinafter.

The two claws of the gripper 5 comprise respectively a flat element 6, centrally affixed to a square bracket 7, and a blade 8 facing the flat element and journalled to a pivot pin 9 mounted to that same square bracket 7. Said square bracket is frontally attached to one end of a tubular shaft 10 which is rotatably supported in a sleeve 11 and the reciprocating rotation whereof causes the gripper 5 to oscillate. The sleeve 11 is attached by means of a flange 12 thereof to the fixed frame 13 of the apparatus.

For the reciprocating rotation of said tubular shaft 10, there is keyed thereto, externally to the sleeve 11, a crank 14 which carries hinged thereto, in the direction of an axis parallel to the axis of the shaft itself, a connecting rod 15 connected with a shaft 16 which is driven of rotative reciprocating motion. Inside the tubular shaft 10, a slidable stem 17 is coaxially positioned, supported at one end in a bushing 18 mounted to the fixed or stationary frame 13, and acting with its other end on one end of the blade 8, against the bias of a helical spring 19 compressively mounted between said blade and the flat element 6 of the gripper 5. To the stem 17, there is attached a tube 20 having a peripherally contoured engagement groove for a pin or stud 21 protruding orthogonally from a rocker arm 22 which is arranged to oscillate in a horizontal plane, and is adapted to cause the stem 17 to move axially in a direction which controls the opening and closing of the jaws of the gripper 5.

The mutual sealing of the two flaps of a tag 2 onto the thread 1 is effected by means of a pair of sealing devices 23*a*, 23*b*, the former of which is stationary (fixed), while the latter is constrained, through a connecting arm 24, with one end of a shaft 25, mounted for oscillation and is axially slidable and parallel to the tubular shaft 10 on the frame 13.

On the shaft 25, there is mounted a further tube 26 having in turn a peripherally contoured groove for engagement with a pin or stud 27 protruding orthogonally from a further rocker arm 28 which is set for oscillating in a horizontal plane, and is adapted to axially shift the shaft 25 in order to open and close the sealing devices 23*a*, 23*b*. Between said tube 26 and a sealing ring 25*a* oriented to face the sealing devices, there is interposed an helical spring 29 adapted to absorb the closure impulse of the sealing device 23*b* onto the sealing device 23*a* to prevent damage. To the shaft 25 is also attached an orthogonally arranged upright 30 the free end of which engages a slot 31 cut longitudinally through the sleeve 11, in order to prevent the shaft 25 from rotating.

Downstream of the guide 4, substantially adjacent to the lower end thereof, there is arranged an intermittently rotatable member which comprises substantially four radial arms arranged along the diagonals of a square in a vertical plane coincident with the plane of the guide itself. Such arms, as will be explained hereinafter, carry means for gripping the thread 1 with a respective tag 2, and for each rotation or stepped movement of the member, equivalent to 90°, they effect a corresponding unwinding of the thread itself. Said rotatable member comprises a holder or support 32 attached, through screw means 33, to a flange 34 keyed to one end of a shaft 35 to which the stepped advance movement is transmitted by means of a gear wheel 36. The shaft 35 is inserted through a coaxial sleeve 37 which is turn journalled, with the interposition of roller bearings, in a hollow body 38 attached to a further portion 39 of the stationary frame 13 of the apparatus. To the sleeve 37, there is keyed, externally to the hollow body 38, a gear wheel 40 which meshes with a gear segment 41 affixed to a connecting rod arm 42, secured onto a drive hub 43 and oscillating in alternate directions in a vertical plane orthogonal to the shaft 35. The movement of the arm 42 is effective to produce the relative angular rotation of the sleeve 37 with respect to the shaft 35.

The support or holder 32 can be of varied shape and defines four radial brackets 44 arranged along said arms of the rotatable member, and as many brackets 45 alternating with the former. The brackets 44 and 45 are contoured in respective parallel planes orthogonal to the axis of the shaft 35, the former being frontally more to the outside than the latter.

To the brackets 44, there are secured through screw means 46, respective plates 47 whereto there are in turn attached, and arranged to face radially outwards, respective pairs of matingly contoured plates 48*a,b* of small thickness and in tight mutual contact. The plates 48*a,b*, mounted through the plates 47 to the brackets 44 of the support 32, form substantially the arms of the rotatable member. The plates 48*a,b* define peripherally between one another respective pockets 49 into which the tags 2 are partially inserted. On either sides of the pockets 49, there are further arranged the means for gripping the thread portion 1, upstream and downstream of each tag. Such gripping means are of the gripper type and comprise serrations 50,51 formed on side extensions of the plates 48*a* only, frontally on the outside, and tabs 52,53 adapted for resting onto the serrations 50, 51 and constituting the movable claws of the gripper. The actuation of the grippers 50–53 is controlled in synchronism by a lifter system driven by the reciprocating motion of the sleeve 37. That system comprises, for each gripper, a rocker arm 54 including a substantially triangular cap having a vertex located close to the shaft 35, to which is attached a pair of parallel tabs 52,53 cooperating with serrations 50,51 related to different and adjacent arms of the rotatable member. The rocker arm 54 has, on its lower face with respect to FIG. 1, two eyes 54*a* and a central opening 54*b*. Through the eyes 54, a pin 55 is passed for articulation to a support 56 which is seated in the opening 54*b*. The rocker arm 54 can be actuated by means of a stud 57 which is held against the inner end 58 of the rocker arm by a cylindrical helical spring 59 arranged on the outer side with respect to the articulation pin 55, between a projection 60 of the rocker arm and the bracket 45.

The stud 57 is threaded and axially led into a stem 61 coaxial thereto, which stem is slidably mounted, with the interposition of a suitable bronze bushing, in a throughgoing seat formed in the support 32, having its axis parallel to the axis of the shaft 35. The stem 61 is driven axially by a cam 62, through an intervening roller 63, which cam is affixed to the sleeve 37. From the stem 61, a pin 64 extends radially, which by engaging a longitudinal slot through the support 32, prevents the stem from rotating and retains the roller 53 in a tangential plane of rotation.

Figure 4:
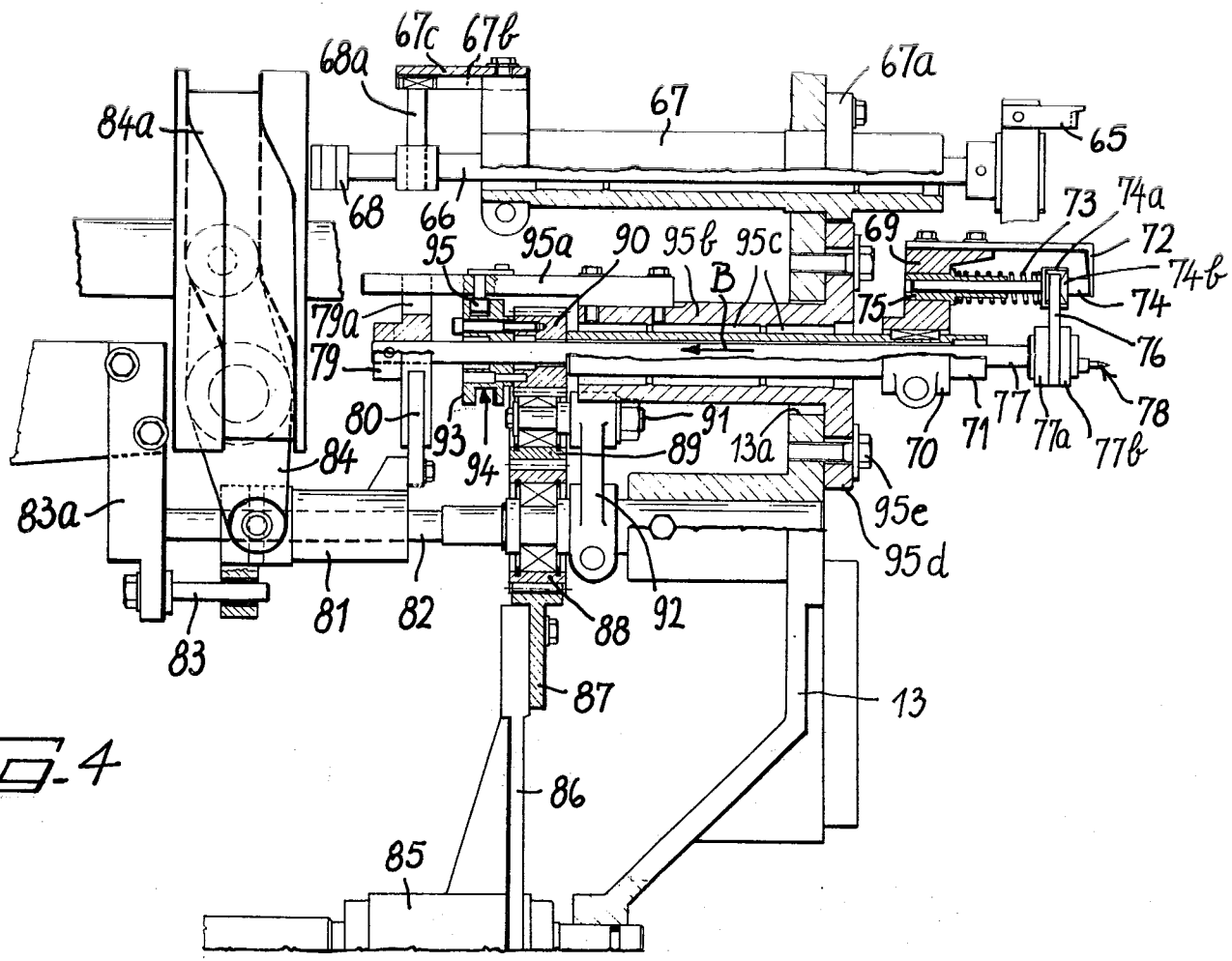
FIG. 4 is a view, in longitudinal section, of the thread-cutting and tag-tilting station.

At the position shown of the arm 48*a,b* of the rotatable member radially opposite to the one adjacent to the lower end of the guide 4, there is located a thread-cutting and tag-tilting station, wherein a loop of sorts is formed in the thread itself. The thread cutting is performed by a knife 65 which cooperates with a mating or counter-knife (not shown) such as to cut the thread downstream of the tag 2, while the preceding thread portion is caught in the upper grippers 50–53. The knife 65 (FIG. 4) is attached to one end of a shaft 66 arranged to slide axially through a sleeve 67, rigid with the frame 13 of the apparatus, by means of a flange 67*a*. The shaft 66 is driven by a rocker arm lever 68 and is prevented from rotating by an arm 68*a* radially rigid therewith and having its free end arranged to slide in a groove 67*b* of a lug 67*c* affixed to the sleeve 67.

To turn the tag over, after cutting the thread 1, there is provided an oscillating arm 69 which is secured, by means of a clamp screw 60, in the proximity of one end of a tube 71 having its axis parallel to that of the shaft 35 of the rotatable member. To the arm 69, there is attached a square bracket 72 which has one end of bill-like configuration which constitutes one claw of a member for gripping the tag to be turned over. The other claw of said gripping member comprises a stem 74, urged by a helical spring 73 and mounted for axial sliding movement parallel to the tube 71, within a guide 75 inserted into and attached to the oscillating arm 69. The spring 73 acts against an embossment 74*a* of the stem 74, which embossment has two parallel facetings 74*b*, wherewith a yoke 76 is engaged pivotally carried at one end of a rod 77 inserted through the tube 71. The yoke 76 is axially retained by a pair of collars 77*a*, 77*b* which are rigid with the rod 77 and carry frictionless bearings for the rotation of the yoke 76. From the rod 77, there protrudes frontally a needle or pin 78 which is offcentered with respect to the axis of the rod 77 and acts as the winding point for the thread during the formation of the loop, as will be apparent hereinafter.

To the opposite end of the rod 77, there is splined a flange 79 provided with a seat wherein a plate 80 is inserted and attached to a sleeve 81 mounted slidably to a fixed guide shaft 82 having its axis parallel to the axis of the rod 77. Between the plate 80 and flange 79, therefore, a coupling is obtained which permits transmission of a longitudinal movement from the sleeve 81 to the rod 77. The sleeve 81 is rotatively hindered by a stem 83 which protrudes in cantilever fashion from an upright 83*a* of the frame. The sleeve 81 is driven along the shaft 82 by a rocker arm 84 which is journalled for oscillation in a vertical plane and is linked to a cam 84, thereby it also controls the axial movement of the rod 77.

For actuating the oscillating arm 69, there is provided a hub 85 which is driven of reciprocating motion and carries a radial arm 86 whereto a gear segment 87 is attached for transmitting the motion to a gear comprising three gear wheels, indicated respectively at 88, 89 and 90, the last-mentioned gear wheel driving, through the tube 71 wherewith it is rotatively associated, the oscillating arm 69. The gear wheels 88, 89 are idle mounted by means of bearings respectively to the shaft 82 and to a pin 91 which protrudes from an arm 92 affixed to the shaft 82.

To the gear wheel 90, which is rotatably mounted and axially displaceable along the rod 77, there is frontally affixed a disk 93, also axially penetrated by the rod 77, which disk has a peripheral groove 94 forming an axial cam engaged by a roller 95 which protrudes downwards from a bracket 95*a*.

Figure 3:
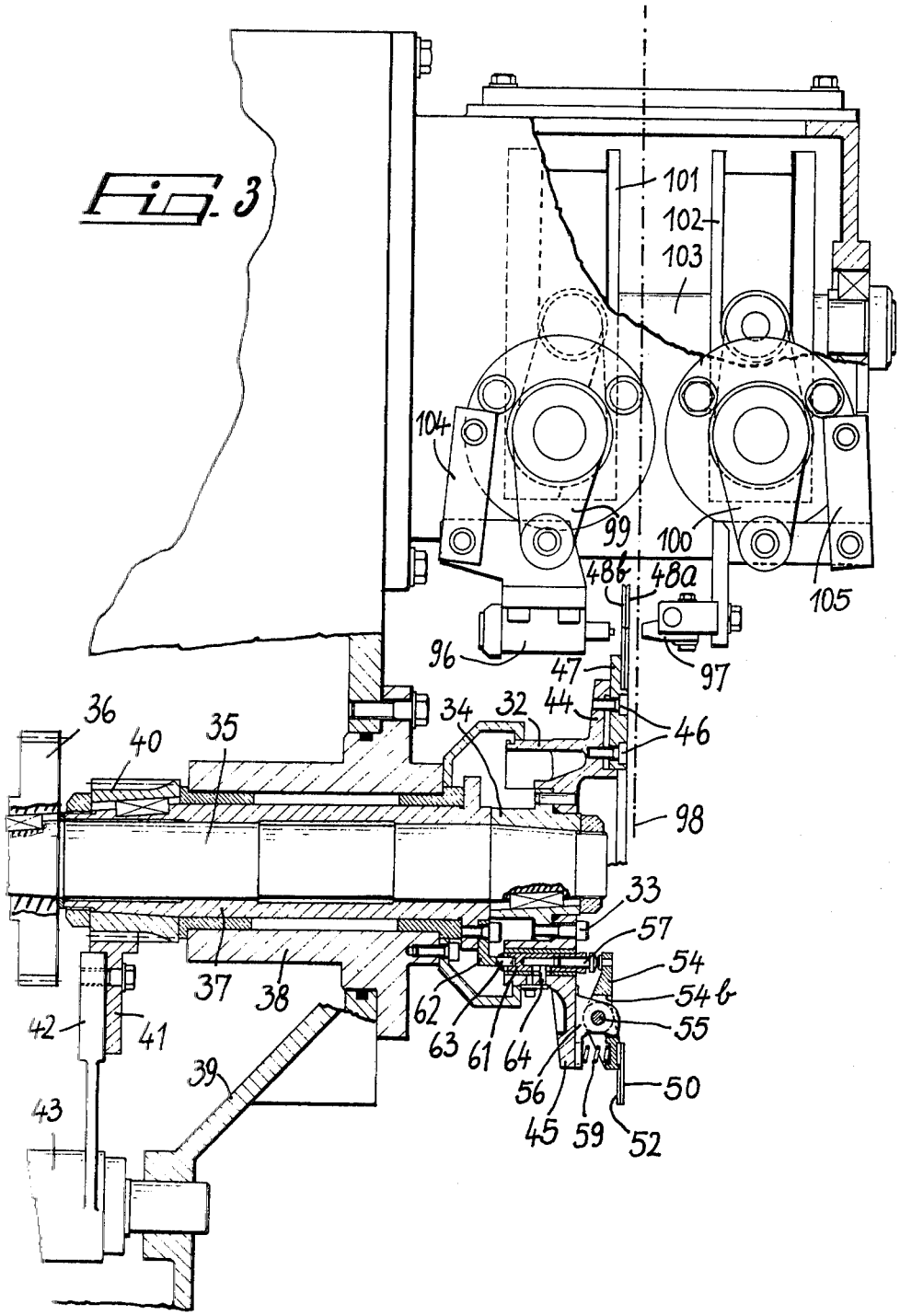
FIG. 3 is a sectional view taken along the line III—III of FIG. 1, illustrating the rotatable member in particular.

The bracket 95*a* is mounted rigidly to a sleeve 95*b*, wherein, with the interposition of frictionless bushings 95*c*, the tube 71 is axially and rotatively displaceable. The sleeve 95*b* projects out of the stationary frame 13 through a slot 13*a* and is provided with a flange 95*d* by means of which it is attached to the frame. The slot 13*a* and the holes in the flange 95*d* through which the fastening bolts 95*e* are passed are elongated to allow for the displacement of the sleeve 95*b* parallel to itself, such as to adjust the position of the axis of the rod 77 and permit the loop forming point to be varied in conformity with the length of the bag thread. The possibility of rotating the rod 77 is hindered by the end of the bracket 95*a* engaging a cutout 79*a* in the flange 79. The cam 94 is adapted for producing the axial translation of the sleeve 71 such as to also produce, during the rotation of the oscillating arm 69, an axial displacement of the same. Downstream of the tag tilting station sealing devices 96,97 are arranged, which cooperate in the application of a thread portion to a web of filter paper 98 (FIGS. 1 and 3), wherefrom conventional filter bags for the infusion product will be subsequently formed. The filter paper 98 moves vertically from the bottom upwards on a plane adjacent the arms 48*a*,*b*, and the sealing devices 96,97 are facing opposite sides thereof and are moved against each other by means of respective rocker arms 99, 100 which are journalled at the middle to the frame and have their upper ends provided with rollers which are guided by cams 101 and 102 keyed to a shaft 103. The rocker arms 99, 100 form together with sealing devices 96, 97 and further connecting rods 104, 105 respective articulated parallelograms for moving the sealing devices 96, 97 parallel to themselves. The sealing devices effect three sealed spots indicated at 106, 107 and 108 in FIG. 1, which are aligned along the thread and across the web of filter paper 98, the spot 106 being effective to anchor one end of the thread, while the other two sealed spots 107 and 108 secure the thread, folded over itself, to opposite sides of the tag 2.

The apparatus just described operates as follows. The thread 1 is run, being dragged along stepwise by the rotatable member, along the guide 4, while at the area upstream of the guide 4, the gripper 5 inserts the tags 2 onto the thread. For controlling the gripper 5, there cooperate in synchronism the rocker arm 22, which through the stem 17 controls its opening, and the shaft 16, which by acting on the tubular shaft 10, causes it to rotate. The gripper opens at the position 5*a* to pick up the tag 2 (which is delivered in a desired lay and at a desired rate by a feeder, not shown) and then closes in the proximity of the fold edge and carries out the angular rotation. Upon completion of the latter, the further rocker arm 28 controls, by acting on the shaft 25, the closing of the sealing device 23*b* against the fixed sealing device 23*a*, such as to secure the two confronting flaps of the tag to the thread 1.

The thread 1 with the tags thereon, which are attached thereto at angular distances apart, proceeds along the guide 4 and is wound peripherally around the rotatable member, the plates 48*a*,48*b* whereof form a grooved edge (as more clearly shown in FIG. 3) for retaining the thread and preventing it from escaping sideways. The thread winding is ensured by the intermittent rotation, in the direction of the arrow A, of the rotatable member, which completes at each step a 90° angular movement.

For a better understanding of the operational steps, it will be assumed that the temporary stop position of FIG. 1 is the initial position, wherein the thread is retained by the upper grippers 50–53, i.e. the ones related to the upper horizontal portion where the sealing takes place, whereas the side and lower grippers are open.

In this condition, the bill of the square bracket 72 and the stem 74 are spaced apart from each other, and the tag 2 is interposed therebetween.

At the following step, the gripping member 72, 74 is closed onto the tag and the lower grippers 50–53 are closed onto the thread. The closing of the gripper member 72, 74 is controlled by the cam 84*a*, which urges, by means of the rocker arm 84, the bushing 81, and accordingly urges the rod 77 outwards, thus enabling the spring 73 to displace the stem 74 against the opposite bill of the square bracket 72 to grip the tag. Simultaneously, the pin 78 is moved to the external side of the thread, directly above the upper side gripper 51, 53.

At this stage, the thread is cut by means of the knife 65 actuated by the rocker arm 68, and the two lower grippers 50–53 are closed. The closing of the lower grippers 50–53 is controlled by the cam 72 rotated by the sleeve 37 which is actuated by the hub 43 through the gear 40–42. The cam 62, in fact, permits the axial displacement of the stem 61 which is urged by the inner end 58 of the rocker arm 54 under the bias of the spring 59.

As the lower grippers are being closed, the upper portion of the thread is sealed across the filter paper 98 by the sealing devices 96, 97. The anchoring of the upper portion of the thread is effected, as mentioned, at the three spots 106, 107, 108; the end portion of the thread included between the knife 65 and the sealed spot 106 is momentarily allowed to hang free, until suitable members, not shown, located downstream of the sealing devices with respect to the direction C of advance of the filter paper, fold it onto the opposing face of the filter paper with respect to the face whereto the tag is attached and seal it close to the edge of said face.

As soon as the lower grippers 50–53 are closed and the thread is cut, the gripping member 72,74 is rotated in the direction D under control of the hub 85 and through the gears 87–90, until it takes the position shown in dot-dash at 69*a* in FIG. 1. During that rotation, the tag 2 is withdrawn from the pocket 49 formed by the plates 48*a*, 48*b* and inserted between the serration 51 and tab 53 which form the upper side gripper, in accordance with the position 2*a*. At the same time, the thread is passed around the pin 78 such as to form a loop of sorts. It should be noted that during the rotation of the gripping member 72, 74, as determined by the cam 94, there occurs an axial movement of the tube 71 and accordingly of the plane containing the tag. This is in order to avoid that the tag may interfere with the thread and locate itself alongside it. A slight inclination of the tag gripping surfaces, namely of the opposing surfaces of the stem 74 and of the bill of the square bracket 72, enables then the tag to remain, upon completion of the rotation, beside the thread with an edge thereof, such as to ensure an accurate gripping action of the gripper 51, 53.

Upon completion of the loop, and under control by the cam 62, the side grippers 50–53 are closed to grip the tag and the thread, while the upper grippers are opened to release the thread onto the paper and the gripping member 70–74 is returned to its initial position by rotation in the opposite direction to the direction D. During that rotation, the sliding movement of the rod 77, as determined by the cam 94, causes the stem 74 to be entrained by the yoke 76, and consequently causes the gripping member 72,74 to be opened and the formed loop to be withdrawn from the needle 78.

The rotatable member performs now a new 90° rotation in the direction A, thereby the vertical thread portion is now laid horizontally and transversally across the front of the paper 98, which, in the meantime, has been advanced one step. The lower horizontal portion takes thus a vertical attitude, and a fresh thread portion is extracted from the guide 4 and positioned for gripping by the lower grippers. The cycle just described is then repeated in accordance with the procedure detailed hereinabove.

Thus, above the rotatable member, there is formed a strip of filter paper which is provided, at regular intervals, with portions of the thread whereto the tag is secured.

The bags are formed in a conventional manner, by first folding the paper longitudinally in half, and then sealing it transversally to produce bags which have one side open for the introduction of the product therein, and finally sealing and separating the individual bags.

It will be appreciated that the invention fully achieves its objects. In particular, the apparatus can develop a very high operation speed, far higher than that of similar machines currently employed for this purpose. Such speed results directly from the possibility provided for the individual parts to perform oscillatory movements of reduced rotational amplitude, and from the small dimensions of the component parts, with attendant reduction of the momenta involved.

Also advantageous is the vertical arrangement of the path for the filter paper, which reduces the apparatus outline dimensions.

In practicing the invention, several modifications and variations are possible which are all intended to fall within the scope of the appended claims.

I claim:

1. An apparatus for applying tags to a web of a filter material adapted to form filter bags in the production of infusion products, said apparatus comprising:

a support;

a rotatable member journaled on said support for rotation about a horizontal axis, said member having a plurality of angularly spaced arms lying substantially in a vertical plane, each of said arms being formed at an extremity with a pocket for receiving a respective tag, and a pair of string clamps flanking said pocket;

guide means for directing a string toward said member from a supply spaced therefrom;

feed means for advancing a succession of folded tags to said guide means and provided with means for fixing said tags at spaced locations to said string with sections of said tags straddling the string, said tags on said string being received in succession in respective pockets of said of said arms upon rotation of said member with the string on either side of said member being engaged in the respective clamps at a receiving station along the path of said arms;

means for guiding said web in a substantially vertical plane across said member, said arms successively arriving at a further station angularly spaced from said receiving station about said axis;

a cutting station disposed between said receiving station and said further station along the path of said arms on rotation of said member provided with means for cutting said string between tags engaged by respective arms whereby a free end of a string is formed at upstream and downstream sides of each tag;

means for looping an upstream free end of a string between a tag at said further station and said web; and means at said further station for bonding a string of each tag to said web at three locations including two locations respectively on an upstream and a downstream side of each tag.

2. The apparatus defined in claim 1 wherein said rotatable member has four such elements angularly equispaced about the axis and the apparatus comprises drive means for intermittently angularly displacing said rotatable member through 90° to step said tags between said stations.

3. The apparatus defined in claim 2 wherein each of said pockets is formed between a pair of parallel plates, one plate of each arm forming fixed claws of a respective pair of string clamps flanking the respective pocket.

4. The apparatus defined in claim 3 wherein each of said string clamps comprises a movable jaw, further comprising lifter means on said rotatable member between said arms for actuating said jaws, and cam means effective upon rotation of said member to operate said lifter means.

5. The apparatus defined in claim 1, claim 2, claim 3 or claim 4 wherein said feed means includes a gripper displaceable between a tag pick-up position and a tag attachment position, and means for oscillating said gripper between said positions.

* * * * *